US009045956B2

(12) United States Patent
Lynde et al.

(10) Patent No.: US 9,045,956 B2
(45) Date of Patent: Jun. 2, 2015

(54) APPARATUS AND METHODS UTILIZING NONEXPLOSIVE ENERGETIC MATERIALS FOR DOWNHOLE APPLICATIONS

(75) Inventors: Gerald D. Lynde, Houston, TX (US); Yang Xu, Houston, TX (US); Bennett M. Richard, Kingwood, TX (US); Douglas J. Murray, Magnolia, TX (US); Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 489 days.

(21) Appl. No.: 13/252,809

(22) Filed: Oct. 4, 2011

(65) Prior Publication Data

US 2013/0081825 A1 Apr. 4, 2013

(51) Int. Cl.

| | |
|---|---|
| ***E21B 29/02*** | (2006.01) |
| ***E21B 23/00*** | (2006.01) |
| ***E21B 33/12*** | (2006.01) |

(52) U.S. Cl.

CPC ..... *E21B 29/02* (2013.01); *E21B 23/00* (2013.01); *E21B 33/12* (2013.01)

(58) Field of Classification Search

CPC ..... E21B 29/00; E21B 29/02; E21B 43/27; E21B 43/28; E21B 43/295

USPC ..... 166/376, 57, 55, 317, 302

See application file for complete search history.

(56) References Cited

U.S. PATENT DOCUMENTS

| | | | | |
|---|---|---|---|---|
| 2,771,140 | A * | 11/1956 | Barclay et al. | 166/60 |
| 5,540,293 | A * | 7/1996 | Mohaupt | 175/3.5 |
| 2005/0281968 | A1 | 12/2005 | Shanholtz et al. | |
| 2007/0284114 | A1 * | 12/2007 | Swor et al. | 166/376 |
| 2008/0202764 | A1 * | 8/2008 | Clayton et al. | 166/376 |
| 2010/0175867 | A1 * | 7/2010 | Wright et al. | 166/57 |

* cited by examiner

*Primary Examiner* — Jennifer H Gay
*Assistant Examiner* — Steven MacDonald
(74) *Attorney, Agent, or Firm* — Cantor Colburn LLP

(57) ABSTRACT

In one aspect, a method of method of performing a wellbore operation is disclosed that in one embodiment may include: providing a device that includes a non-explosive energetic material configured to disintegrate when subjected to a selected energy; placing the device at a selected location in the wellbore to perform a selected function; and subjecting the device to the selected energy to disintegrate the device in the wellbore after the device has performed the selected function. In another aspect an apparatus for use in a wellbore is disclosed that in one embodiment may include a device placed in the wellbore at a selected location, wherein the device includes a non-explosive energetic material configured to disintegrate when subjected to a selected energy, and a source of the selected energy configured to subject the device to the selected energy in the wellbore to disintegrate the device.

22 Claims, 3 Drawing Sheets

APPARATUS AND METHODS UTILIZING NONEXPLOSIVE ENERGETIC MATERIALS FOR DOWNHOLE APPLICATIONS

BACKGROUND

1. Field of the Disclosure

This disclosure relates generally to members and devices containing non-explosive energetic material that may be disintegrated downhole.

2. Background of the Art

Oil wells (also referred to as wellbores or boreholes) are drilled in subsurface formations for the production of hydrocarbons. A wellbore may be an open-hole wellbore or a cased-hole wellbore. The cased-hole well includes a casing (also referred to as "liner"), typically a steel tubular, inside the wellbore. Open holes are not lined with the casing. In either case, a production string is installed inside the casing or the open-hole to produce the formation fluids to the surface. Often, elements or devices are placed in the wellbore to perform a function and then are removed from the wellbore. Such devices include, for example, ball/ball seat assemblies, plugs and packers. To remove a device from a wellbore, a drilling or milling tool is often conveyed into the wellbore drill or mill the device. Such a process requires a secondary operation that is often complex and time-consuming. In other cases, such devices may be formed of a corrodible material that disintegrates over time. In such cases the device to be integrated may remain in the wellbore for a relatively long time period after it has performed its intended function.

The disclosure herein provides devices or articles that include non-explosive energetic materials that may be disintegrated by applying a suitable energy to such devices downhole.

SUMMARY

In one aspect a method of performing a wellbore operation is disclosed that in one embodiment may include: providing a device that includes a non-explosive energetic material configured to disintegrate when subjected to a selected energy; placing the device at a selected location in the wellbore to perform a selected function; and subjecting the device to the selected energy to disintegrate the device in the wellbore after the device has performed the selected function.

In another aspect an apparatus for use in a wellbore is disclosed that in one embodiment may include a device placed in the wellbore at a selected location, wherein the device includes a non-explosive energetic material configured to disintegrate when subjected to a selected energy, and a source of the selected energy configured to subject the device to the selected energy in the wellbore to disintegrate the device.

Examples of various features of the apparatus and methods disclosed herein are summarized rather broadly in order that the detailed description thereof that follows may be better understood. There are, of course, additional features of the apparatus and methods disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
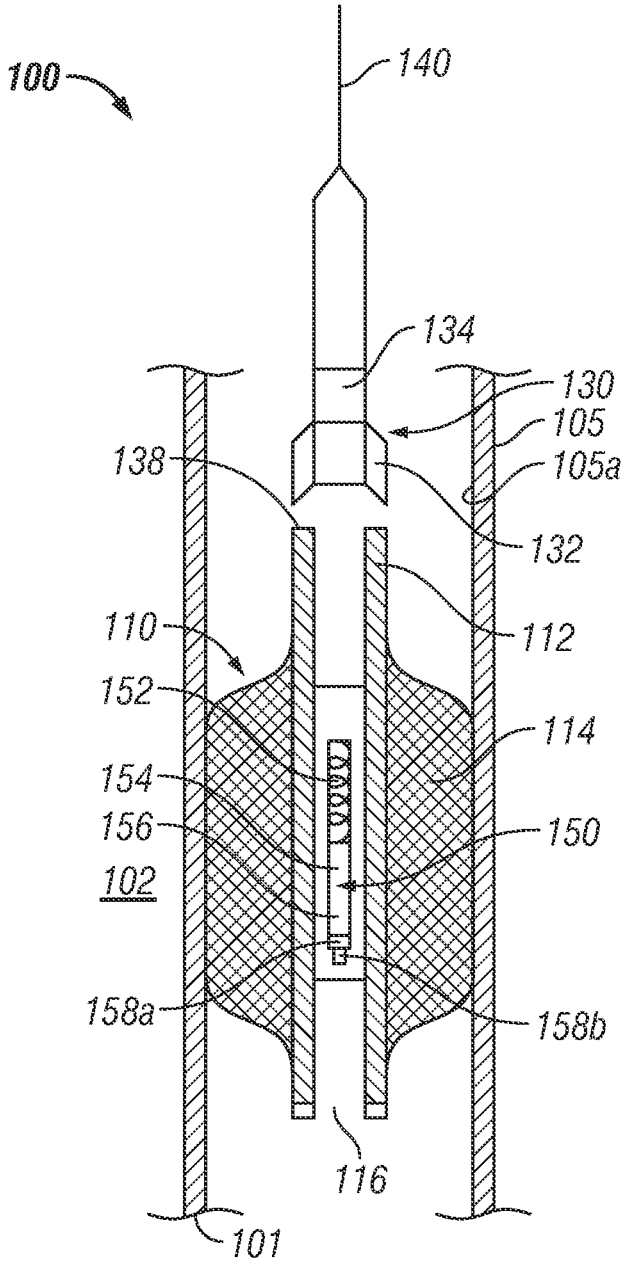
FIG. 1 is a line drawing of an exemplary device placed at selected location in a wellbore that is made at least in part from a non-explosive energetic material and a tool conveyed from the surface to heat the device to disintegrate the device in the wellbore.

FIG. 1 is a line drawing of an exemplary wellbore system 100 for performing a downhole operation according to one embodiment of the disclosure. The system 100 includes a wellbore 101 formed in an earth formation 102. The wellbore 101 is lined with a casing 105, such as steel tubing. A device 110 is placed at selected location 105*a* in the casing, which device is intended to be disintegrated after it has performed an intended function in the wellbore 101. The exemplary device 110 is a sealing device, such as a packer. The device 110 includes a mandrel 112 and an expandable sealing member 114 around the mandrel 112. The sealing member 114 is shown in an expanded position such that it presses against the inside 105*a* of the casing to seal the wellbore above and below the sealing member 114. In aspects, the mandrel 112 and/or the sealing member 114 or a part of such elements is formed from a non-explosive energetic material configured to disintegrate when exposed to a selected energy. In aspects, when the non-explosive energetic material is exposed to a sufficient amount of the selected energy, it deflagrates, thus causing it to disintegrate over a time period. In one aspect, the selected energy is heat. The system 100 further includes a tool or source 130 configured to expose the device 110 to heat. In the particular embodiment of FIG. 1, the tool 130 is an electrical tool or device that includes a heating element 132, such as a coil and an energy source 134. When the device 110 has performed its intended operation or when it is otherwise desired to disintegrate the device, the source tool 130 is conveyed into the wellbore 101 by a suitable conveying member 140, such as a wireline, tubing or coiled-tubing. The tool 130 is placed proximate or in contact with the device 110 and activated to supply the electrical energy to the heating element 132 to cause it to produce heat sufficient to heat the device 110 to deflagrate it and thus disintegrate. Once the device 110 has disintegrated by a desired amount the tool 130 is retrieved to the surface. In such a tool, the electrical current to the heating element 132 may be provided from the surface via conductors in the conveying member 140.

Alternatively, a heating tool 150 may be placed in the wellbore proximate to the device 110. In one aspect the heating tool 150 may include a heating element 152, such as a coil, a battery 154 and a circuit 156. The circuit 156 may further include a timer 158*a* or a receiver 158*b*, each configured to activate the battery to supply electrical energy to the coil 152. In the configuration that includes a timer, it is preset and upon the expiration of such time, the circuit 156 activates the battery 154 to supply current to the coil 152, which generates heat sufficient to deflagrate the device 110. In the configuration of the heating tool 150 that includes a receiver, the circuit 156 activates the battery 154 in response to a remote signal received by the receiver 158*b*. The remote signal may be sent from the surface or another suitable location. In aspects, the remote signal may be a radio frequency signal, an acoustic signal, an electromagnetic signal or any other suitable signal. In aspects, the remote signal may be transmitted from a suitable surface location. In another aspect, the device tool or source may be an impact tool wherein the device 110 deflagrates when it is subjected to an impact load, which is described in reference to FIG. 3.

Figure 2:
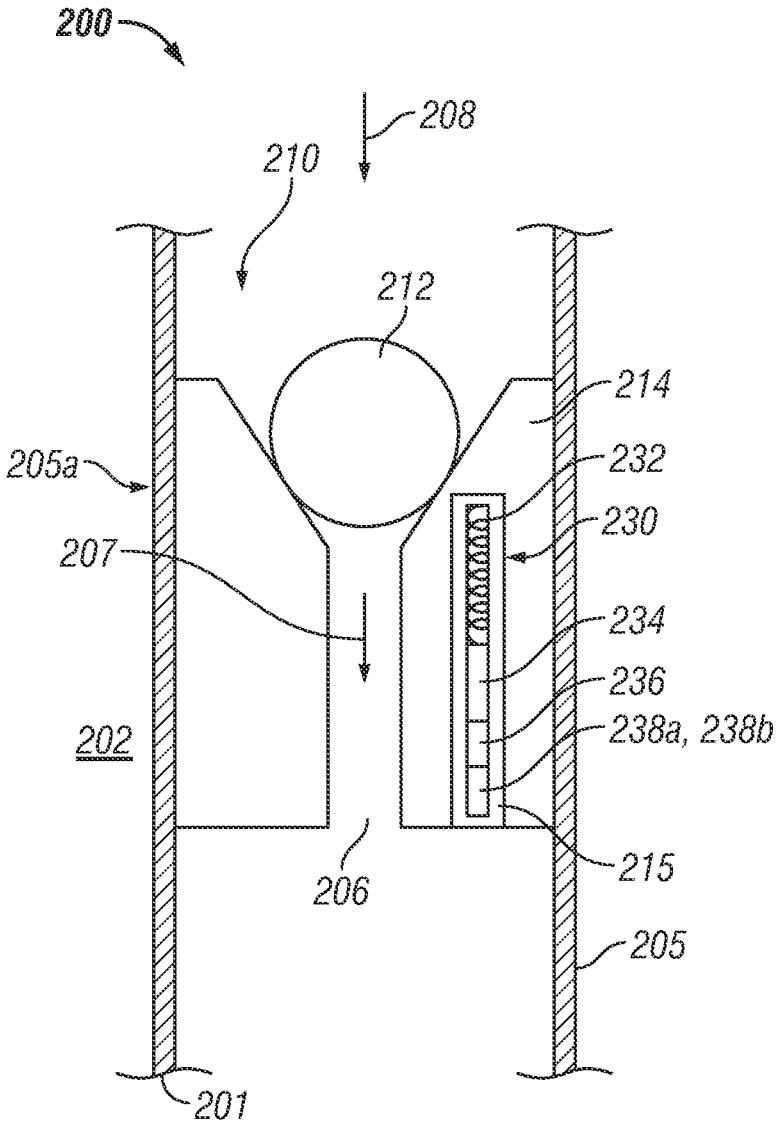
FIG. 2 is a line drawing of another exemplary device placed at a selected location in a wellbore that is made at least in part from a non-explosive energetic material and a heating tool that includes a battery and a heating element placed in the wellbore to heat the device to disintegrate the device in the wellbore.

FIG. 2 is a line drawing of an exemplary wellbore system 200 for performing a downhole operation according to another embodiment of the disclosure. The system 200 includes a wellbore 201 formed in an earth formation 202. The wellbore 201 is lined with a casing 205, such as steel tubing. A device 210 is placed at selected location 205*a* in the casing 205, which device is intended to be disintegrated after it has performed an intended function in the wellbore 201. The exemplary device 210 includes a ball 212 seated on a ball seat 214 in the bore 206 of the casing 205. The ball 212 prevents the flow of a fluid 208 through the bore 206 along the downhole direction 207. In aspects, the ball 212 and/or the ball seat 214 or a part of such elements is formed from a non-explosive energetic material configured to disintegrate when exposed to a selected energy. In aspects, when the non-explosive energetic material is exposed to a sufficient amount of the selected energy, it deflagrates, thus causing it to disintegrate over a time period. In one aspect, the selected energy is heat. The system 200 further includes a tool or source 230 configured to expose the device 210 to heat. In the particular embodiment of FIG. 2, the source 230 is an electrical tool or device that includes a heating element 232, such a as a coil, placed proximate to the ball 212. In the specific configuration of FIG. 2, the heating element 232 is shown securely placed inside a pocket 215 of the ball seat 214. The source 230 further includes a source of electrical energy 234, such as a battery, that supplies electrical energy (current) to the heating element 232 which generates heat to a selected or desired temperature that is sufficient to cause the non-explosive energetic material to deflagrate. In one configuration, the source 230 may include an electrical circuit 236 and a timer 238*a* or receiver 238*b*. In aspects, the timer 238*a* may be preset prior to deploying the tool 230 in the wellbore. In the case of a receiver, the battery 234 may be activated by the circuit in response to receiving a remote signal received by a receiver 238*b*. In aspects, the remote signal may be a radio frequency signal, an acoustic signal, an electromagnetic signal or any other suitable signal. In aspects, the remote signal may be transmitted from a suitable surface location.

When the source 230 includes a preset timer, the battery activates when the preset time expires and supplies current to heat the heating element 232. The generated heat heats the non-explosive energetic material in the ball 112 and/or the ball seat 214 to initiate deflagration of such devices. When the source 230 includes a receiver 238*b*, a command signal is sent to the receiver 238*b* and the circuit 236 activates the timer or the battery 234 to supply current to the heating element 232.

Figure 3:
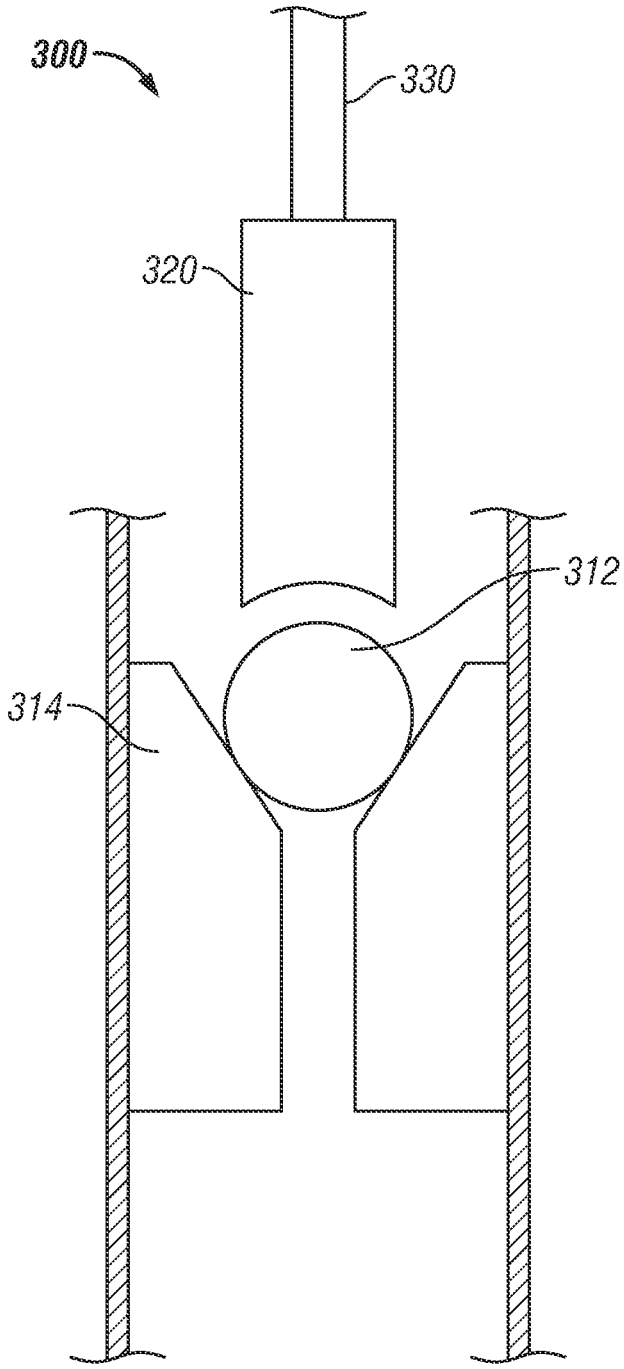
FIG. 3 is a line drawing of an exemplary device placed at a selected location in a wellbore that is made at least in part from a non-explosive energetic material and an impact tool configured to deflagrate the device by an impact load.

In the embodiments of FIGS. 1 and 2, the non-explosive energetic material is exposed to direct heat to cause it to deflagrate. In aspects, such materials may also be deflgrated by impact loads. FIG. 3 is a line diagram showing a ball 312 and a ball seat 314 in the wellbore that may be deflagated by an impact load. In such a configuration, an impact tool 320 may be conveyed from a surface location by a suitable conveying member 330 to impact the ball 312 with a sufficient force to cause the ball 312 and/or ball seat 314 to deflagrate and thus disintegrate.

The exemplary embodiments show only examples of certain devices for use in wellbores that include non-explosive energetic materials that may be disintegrated downhole. Any device that may utilize non-explosive energetic material may be used for the purposes of this disclosure. Such other device may include, but are not limited to, a plug, sections of a casing, a locking device, a release ring, an o-ring, a support of a retrievable tool, and an anchor member of a retrievable tool.

In the devices for use according to this disclosure, any suitable non-energetic material may be utilized. In one aspect, the device may include an energetic material mixed with a suitable rubber or composite material in a manner that the device is not classified as an explosive so that it may be transported by normal transportation means, such as trucks, and can be handled by operators and deployed into the wellbore. The device will not disintegrate until it is exposed to a selected energy as described hereinabove.

In aspect a device desired to be disintegrated may be any material combination that includes a non-explosive energetic material so that the device possess initial strength required to perform the intended downhole function and that can then be removed when exposed to a selected energy, such as heat or an impact load. In one aspect, the energetic material may include an energetic resin and a reinforcement filler. The filler may be any suitable material, including, but not limited to, rubber and a composite material.

The composite energetic materials also have sufficient structural integrity to allow manufacture of structural components. The material can be deflagrated or detonated upon proper exposure to a selected energy. The material can act as both a structural component as well as being the explosive device. In some embodiments the energetic resin may be a two-part thermosetting system in which a component A is reacted with a component B to form an energetic resin, and, in some embodiments, the energetic resin may be a one part system. One suitable class of energetic resins are those in which component A includes at least one polymer having two or more azide moieties and a component B that includes at least one polyfunctional compound that has two or more carbon-carbon double or triple bonds adjacent to an activating moiety. Another suitable class of resins include those formed by the reaction of component A which includes an energetically substituted alkyl diisocyanate such as those substituted with nitro- or nitraza groups and component B includes a polyol. Suitable examples of substituted diisocyanates include, but are not limited to, 3,3,5,7,7-pentanitro-5-aza-1,9-nonane diisocyanate; 2-nitraza-1,4,butane-diisocyanate; 2,5-dinitraza-1,6-hexane diisocyanate; and so forth. Another suitable class of energetic resins include those which are a one-part system which employs a free radical cured energetically substituted vinyl compound. Examples of such compounds include, but are not limited to, nitroethyl methacrylate, dinitroporpyl acrylate, trinitroethyl acrylate, and so forth. Any suitable initiators known in the art such as peroxides, for example, may be employed. Such material are described in more detail published application 2005/0281968, which is incorporated herein by reference.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

The invention claimed is:

1. A method of performing a wellbore operation, comprising:

providing a device that consists of a non-explosive energetic material configured to disintegrate when subjected to a selected energy, wherein the selected energy is heat;

placing the device at a selected location in the wellbore to perform a selected function;

deploying a heating tool in the wellbore wherein the heating tool includes an electrical heating element placed proximate to the device;

heating the non-explosive energetic material using the electrical heating element; and subjecting the device to the selected energy via the electrical heating element to provide heat sufficient to disintegrate the device in the wellbore after the device has performed the selected function.

2. The method of claim 1, wherein the heating tool further includes a member conveyed from the surface to provide energy to the electrical heating element to heat the device to a selected temperature.

3. The method of claim 1, wherein the heating tool includes a battery in the wellbore; and further comprising activating the battery to activate the electrical heating element to heat the device to the selected temperature.

4. The method of claim 3, wherein activating the battery comprises one of activating the battery using a timer associated with the battery; or a control signal transmitted to a receiver associated with the battery.

5. The method of claim 1, wherein the non-explosive energetic material deflagrates when subjected to the selected energy.

6. The method of claim 1, wherein the device comprises the non-explosive energetic material mixed with a material selected from a group consisting of: rubber; an alloy; and a composite material.

7. The method of claim 1, wherein deploying the heating tool comprises conveying the tool in the wellbore by a member selected from a group consisting of a: wireline; and a tubing.

8. The method of claim 1, wherein the device is selected from a group consisting of: a plug; a ball; a ball seat; sections of a casing; a packer; a locking device; a release ring; an o-ring; a support of a retrievable tool; and an anchor member of a retrievable tool.

9. An apparatus for use in a wellbore, comprising:

a device placed in the wellbore at a selected location, wherein the device consists of a non-explosive energetic material configured to disintegrate when subjected to a selected energy; and a source of the selected energy configured to subject the device to the selected energy in the wellbore to disintegrate the device wherein the source of the selected energy is a heating tool configured to be conveyed in the wellbore wherein the heating tool includes an electrical heating element placed proximate to the device in the wellbore, further configured to subject the device to the selected energy via the electrical heating element to provide heat sufficient to disintegrate the non-explosive energetic material.

10. The apparatus of claim 9, wherein the heating tool is further configured to be conveyed in the wellbore by one of a wireline, or tubing.

11. The apparatus of claim 9, wherein the heating tool further includes a member conveyed from the surface to provide energy to the electrical heating element to heat the device to a selected temperature.

12. The apparatus of claim 9, wherein the heating tool further comprises a battery in the wellbore.

13. The apparatus of claim 12, wherein the heating tool further comprises one of: a timer associated with the battery configured to activate the battery to supply current to the electrical heating element; and a receiver associated with the battery configured to activate the battery to supply current to the electrical heating element in response to a signal received from a remote location.

14. The apparatus of claim 9, wherein the non-explosive energetic material deflagrates when subjected to the selected energy.

15. The apparatus of claim 9, wherein the device comprises the non-explosive energetic material mixed with a material selected from a group consisting of: rubber; an alloy;

and a composite material.

16. The apparatus of claim 9, wherein the device is selected from a group consisting of: a plug; a ball; a ball seat; a packer; a locking device; a release ring; an o-ring; a support of a retrievable tool; and an anchor member of a retrievable tool.

17. A method of performing a wellbore operation, comprising:

providing a device that consists of a non-explosive energetic material configured to deflagrate when subjected to a selected energy wherein the selected energy is an impact load;

placing the device at a selected location in the wellbore to perform a selected function;

impacting the non-explosive energetic material by a tool conveyed from a surface location; and subjecting the device to the selected energy via the impact load deflagrate the non-explosive energetic material in the wellbore after the device has performed the selected function.

18. The method of claim 17, wherein the device comprises the non-explosive energetic material mixed with a material selected from a group consisting of: rubber; an alloy; and a composite material.

19. The method of claim 17, wherein the device is selected from a group consisting of: a plug; a ball; a ball seat; sections of a casing; a packer; a locking device; a release ring;

an o-ring; a support of a retrievable tool; and an anchor member of a retrievable tool.

20. An apparatus for use in a wellbore, comprising:

a device placed in the wellbore at a selected location, wherein the device consists of a non-explosive energetic material configured to deflagrate when subjected to a selected energy; and a source of the selected energy configured to subject the device to the selected energy in the wellbore to disintegrate the non-explosive energetic material wherein the source is an impact tool configured to be conveyed from a surface location to provide an impact to the device via the impact tool to cause the non-explosive energetic material to deflagrate in the wellbore.

21. The apparatus of claim 20, wherein the device comprises the non-explosive energetic material mixed with a material selected from a group consisting of: rubber; an alloy;

and a composite material.

22. The apparatus of claim 20, wherein the device is selected from a group consisting of: a plug; a ball; a ball seat; a packer; a locking device; a release ring; an o-ring; a support of a retrievable tool; and an anchor member of a retrievable tool.

* * * * *